United States Patent [19]

Abe et al.

[11] 4,152,978

[45] May 8, 1979

[54] METHODS AND APPARATUS FOR CHANGING DIES IN A PRESS AND STOCKING THEM

[75] Inventors: Haruhisa Abe, Sagamihara; Mikio Yonekura, Hatano, both of Japan

[73] Assignee: Amada Company, Ltd., Isejara, Japan

[21] Appl. No.: 829,424

[22] Filed: Aug. 31, 1977

[30] Foreign Application Priority Data

Aug. 31, 1976 [JP] Japan ..... 51/103090

[51] Int. Cl.[2] ..... B30B 15/02

[52] U.S. Cl. ..... 100/35; 72/446; 100/DIG. 18; 100/229 R; 100/231

[58] Field of Search ..... 100/DIG. 18, 35, 229 R, 100/231; 72/446, 448; 214/1 BB; 83/698

[56] References Cited

U.S. PATENT DOCUMENTS

| | | | |
|---|---|---|---|
| 2,910,727 | 11/1959 | Salbeck | 100/229 R X |
| 3,111,100 | 11/1963 | Georgeff | 100/229 R X |
| 3,139,676 | 7/1964 | Grover | 100/DIG. 18 |
| 3,230,869 | 1/1966 | Wilkins | 100/DIG. 18 |
| 3,335,657 | 8/1967 | Clements | 100/35 |
| 3,455,141 | 7/1969 | Bracco | 72/446 |
| 3,559,522 | 2/1971 | Valente | 100/229 R X |

FOREIGN PATENT DOCUMENTS

| | | | |
|---|---|---|---|
| 777110 | 6/1957 | United Kingdom | 100/DIG. 18 |
| 950884 | 2/1964 | United Kingdom | 100/DIG. 18 |

*Primary Examiner*—Billy J. Wilhite
*Attorney, Agent, or Firm*—Wigman & Cohen

[57] ABSTRACT

This disclosure relates to a method and apparatus for changing dies in a press and for storing dies not in use in a storage rack associated with the press. The press includes a work table disposed beneath the ram of the press and having means for moving dies from a "waiting position" at the left of the ram to a "working position" beneath the ram and then to a "retiring position" to the right of the ram. A die returning conveyor returns dies from the "retiring position" to a die transferring carriage disposed behind the ram from where they are automatically transferred to an adjacent storage rack. When a particular die is desired, it is automatically removed from the storage rack by the die transferring carriage, and then conveyed to the "waiting position" by means of a die advancing conveyor.

8 Claims, 25 Drawing Figures

METHODS AND APPARATUS FOR CHANGING DIES IN A PRESS AND STOCKING THEM

BACKGROUND OF THE INVENTION

1. Field of the Invention

The present invention relates generally to presses and more particularly to apparatus for installing and removing dies in presses and stocking them.

2. Description of the Prior Art

Although presses have been primarily developed as an advantageous and economical means for producing works in large quantities, they are now actually often used to produce a larger variety of works in small quantities. Accordingly, it is very frequently required to change dies in a press when changing from one production run to another, and, for this purpose, it is necessary to prepare and stock a variety of dies for a variety of works.

Heretofore, such die changeovers have been ordinarily manually accomplished, and it has been usual that such a variety of dies are stocked in storages located far apart from the presses. Accordingly, it has been required for operators of presses to remove and install large and heavy dies in presses and carry them from the presses to the storages and vice versa.

Of course, such a die changeover is time-consuming, and it is necessary to shut down operation of the press for a considerable time with the result that the productive output is obviously reduced. Also, it is difficult and dangerous to change large and heavy dies in the usual manner, and such die changeover is required to be done by a skilled operator mostly with the aid of one or more assistants. Furthermore, a variety of dies requires not only the aforementioned time-consuming labors but also a larger space for storage as in the conventional manner. Accordingly, several presses for a variety of dies are often employed simply in order to avoid frequent die changeovers.

SUMMARY OF THE INVENTION

It is a primary object of the present invention to provide a method and apparatus for easily and quickly changing dies in a press.

More particularly, it is an object of the present invention to provide a method and apparatus for eliminating difficult and time-consuming labors for changing dies in a press and minimizing shutdown time while effecting die changeovers in the press.

It is also an object of the present invention to provide a method and apparatus for fully automatically changing dies to eliminate difficult, dangerous and time-consuming labors.

It is a more specific object of the present invention to provide a method and apparatus for automatically carrying dies from their storage to the working position of a press and vice versa.

It is another specific object of the present invention to provide apparatus for removing and installing dies in a press.

It is a further object of the present invention to provide apparatus for stocking dies for a press.

Basically, these objects are accomplished by providing a press with an upper and lower die clamping means, die conveying means for conveying dies towards and away from the working position of the press, a rack means of a single or plural stories for stocking dies and a die carriage means for transferring dies from the die stocking rack means to the die conveying means and vice versa. These means are designed to be automatically operated by means of hydraulic or pneumatic motors and chain sprocket drives.

Other and further objects and advantages of the present invention will be apparent from the following description and accompanying drawings which, by way of illustration, show a preferred embodiment of the present invention and the principle thereof.

DESCRIPTION OF THE PREFERRED EMBODIMENT

Figure 1:
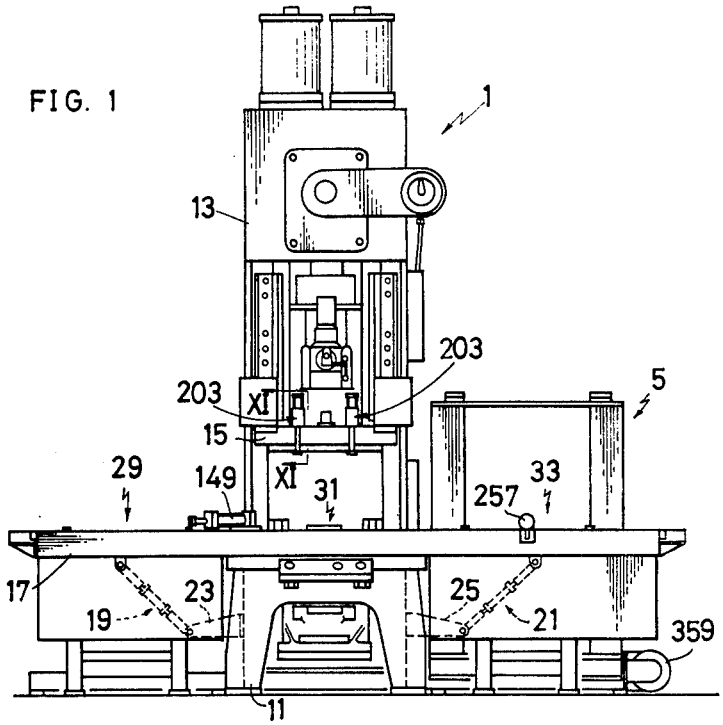
FIG. 1 is a front view of an integrated apparatus according to the present invention.
Figure 2:
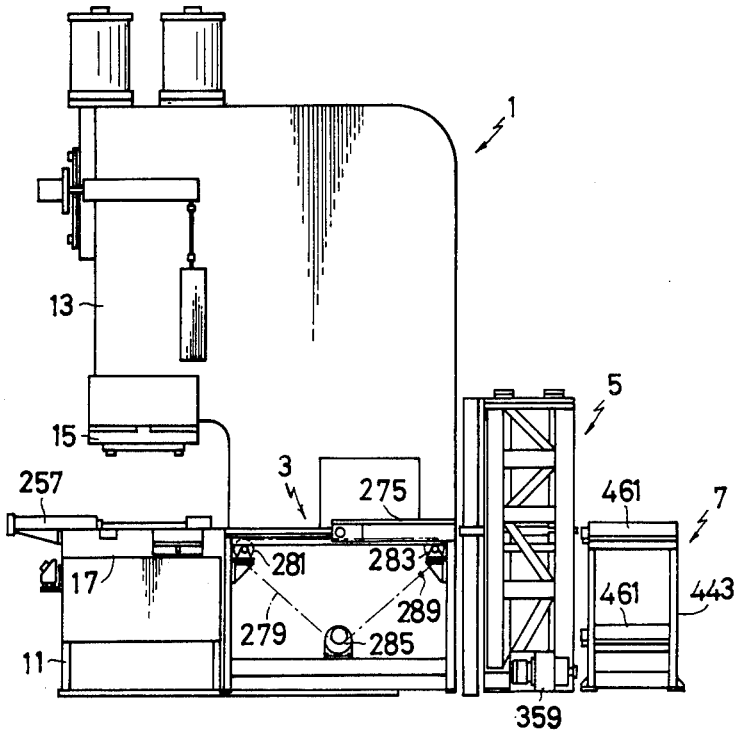
FIG. 2 is a side elevational view of the apparatus shown in FIG. 1.

For convenience in description, it is initially to be noted that the terms "upper", "lower", "front", "rear", "right" and "left" and words of similar import will be used as they are usually used with reference to the press 1 including its related apparatus as shown in FIGS. 1 and 2. Specifically, the terms "upper" and "lower" will designate upper and lower sides, respectively, in FIGS. 1 and 2, "front" and "rear" left-hand and right-hand sides, respectively, in FIG. 2 and "right" and "left" right-hand and let-hand sides, respectively, in FIG. 1.

Figure 3:
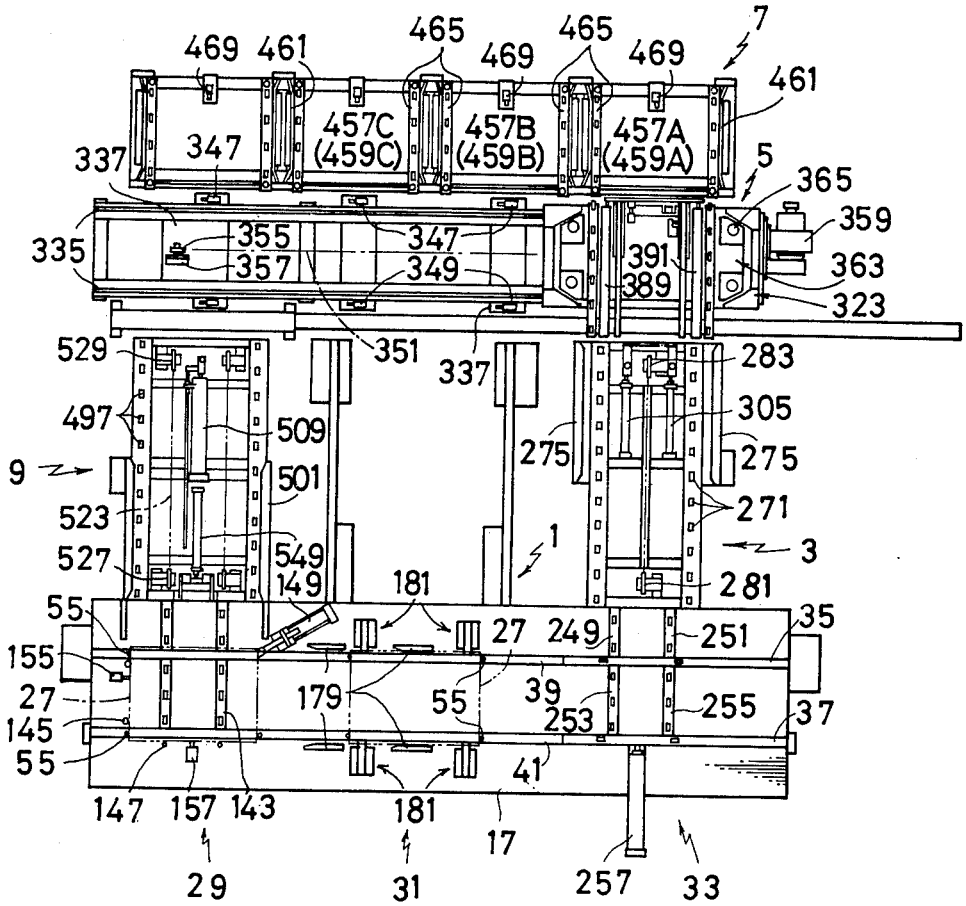
FIG. 3 is a plan view of the apparatus shown in FIGS. 1 and 2, with the central portion thereof being omitted for clarity.

Referring to FIGS. 1, 2 and 3, the press 1 is equipped with an integrated apparatus which comprises a die returning conveyor 3 fixedly placed by the right-hand side of the press 1, a die transferring carriage 5 movably provided just behind the press 1, a die stocking rack 7 fixedly placed behind the die transferring carrage 5 in parallel therewith and a die advancing conveyor 9 fixedly placed at the left-hand side of the press 1.

The press 1 itself is more or less conventional in function and construction as a whole, and it is constructed of a base 11 and a C-shaped frame 13. However, the press 1 embodies also a part of the present invention, as described in more detail hereinafter.

Generally stated, dies or die-sets unloaded from the press 1 are carried rearwards by the die returning conveyor 3 and then are received and transferred by the die transferring carriage 5 into the die stocking rack 7 for storage, while dies to be newly used are taken out and transferred by the die transferring carriage 5 from the die stocking rack 7 to the die advancing conveyor 9 and then carried forwards to be loaded onto the press 1.

As best shown in FIGS. 1 and 2, an elongated wide and flat table 17 is provided on the base 11 of the press 1 and beneath the ram 15 of the same, and both ends of the table 17 are supported by supporting members 19 and 21 which are also supported by brackets 23 and 25, respectively, which are fixed to the base 11.

Figure 4:
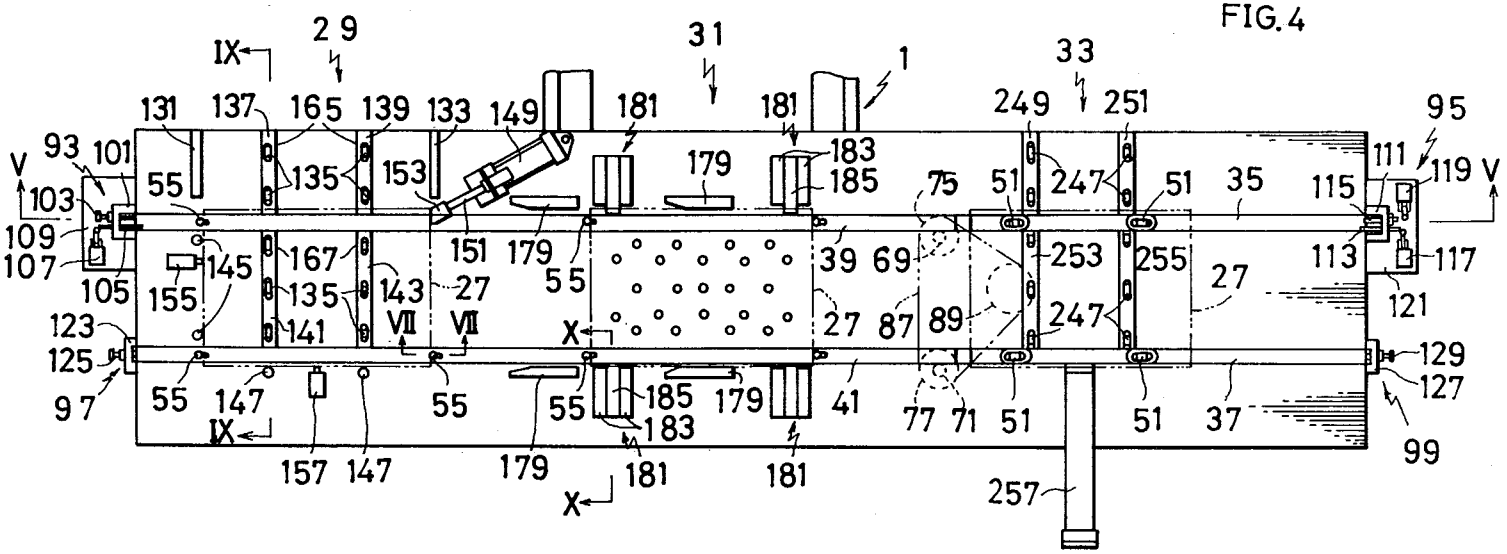
FIG. 4 is an enlarged partial plan view of the apparatus corresponding to the front portion of FIG. 3.

In the preferred embodiment, a pair of upper and lower dies or die-set 27 shown by imaginary lines in FIGS. 3 and 4 is brought out by the die advancing conveyor 9 onto the left-hand end 29 of the table 17 and then carried rightwards and positioned for working at the central portion 31 of the same located just beneath the ram 15. Also, after working, the die-set 27 is carried further to the right-hand end 33 of the table 17 and then transferred tc the die returning conveyor 3. Accordingly, the left-hand end 29, the central portion 31 and the right-hand end 33 of the table 17 will be called hereinafter "waiting position", "working position" and "retiring position", respectively.

As best shown in FIG. 4, a plurality of elongate guide slots 35 and 37 are horizontally formed on the top of the table 17 along the length thereof, and elongate carrier bars 39 and 41 each having a rectangular section are horizontally movably put in the guide slots 35 and 37, respectively. The carrier bars 39 and 41 are designed to work together to move the die-set 27 from the waiting position 29 to the working position 31 and from the working position 31 to the retiring position 33, and each of them has a length substantially corresponding to the distances between the waiting position 29 and the working positions 31 and between the working positions 31 and the retiring position 33.

Figure 5:
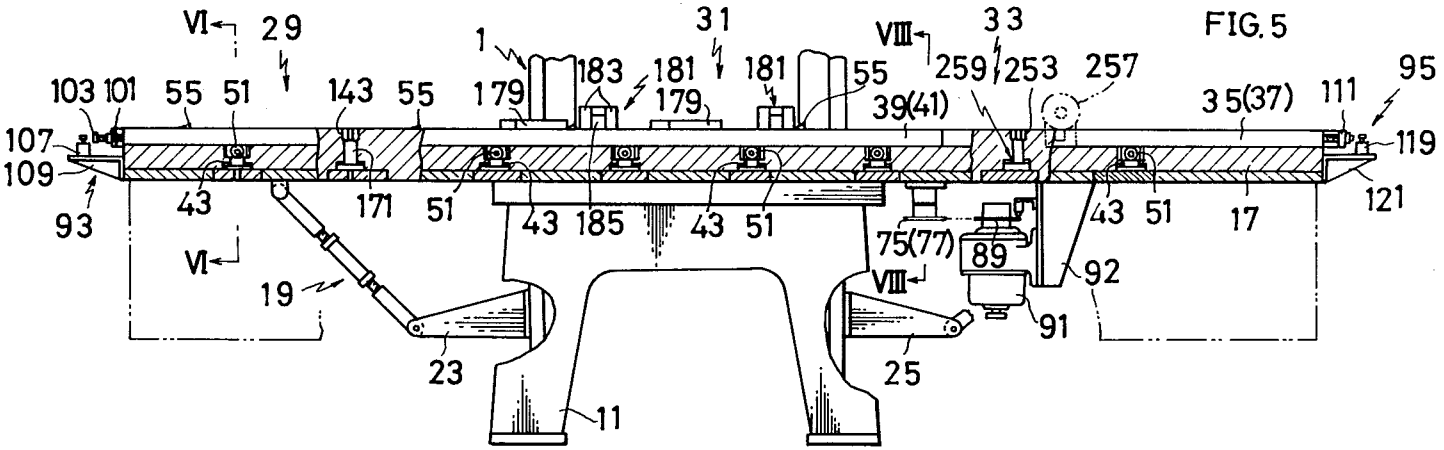
FIG. 5 is a front sectional view of the apparatus taken along the line V—V of FIG. 4.
Figure 6:
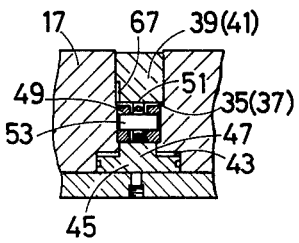
FIG. 6 is an enlarged sectional view taken for instance along the line VI—VI of FIG. 5.

Since the carrier bars 39 and 41 do not project out from the guide slots 35 and 37 when not worked, a plurality of hydraulic cylinders 43 acting as hydraulic motors are provided just beneath the guide slots 35 and 37 at suitable intervals as shown in FIG. 5 so as to raise the carrier bars 39 and 41. As detailedly shown in FIG. 6, each of the hydraulic cylinders 43 has a piston 45 having a piston rod 47 which supports a supporting block 49, and a roller 51 is rotatably supported by means of a pin 53 on the supporting block 49 in each of the hydraulic cylinders 43. Thus, the carrier bars 39 and 41 are horizontally movably supported on the rollers 51 and are designed to be raised to project out from the top of the table 17 when the rollers 51 are raised by the hydraulic motors 43. It will be understood that the carrier bars 39 and 41 are raised by the rollers 51 to raise the die-set 27 out of contact with the top surface of the table 17 to carry the same rightwards along the guide slots 35 and 37.

Figure 7:
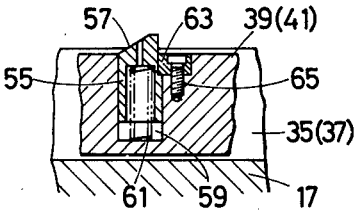
FIG. 7 is an enlarged sectional view taken for instance along the line VII—VII of FIG. 4.

As shown in FIGS. 4 and 5, each of the carrier bars 39 and 41 is provided at its top with a plurality of catch members 55 each having a slope 57 descending leftwards in a manner such that they are equally spaced on both of the carrier bars 39 and 41 from their ends. As detailedly shown in FIG. 7, each of the catch members 55 is vertically slidably inserted in a vertical bore 59 formed on the carrier bars 39 and 41, and it is upwardly biased by a spring 61 and prevented from jumping out by a stop member 63 fixed by a bolt 65. These catch members 55 are provided to prevent the die-set 27 from slipping on the carrier bars 39 and 41 when carried thereby and positively move the die-set 27 rightwards on the table 17.

Figure 8:
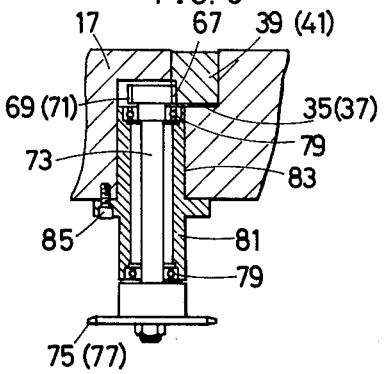
FIG. 8 is an enlarged sectional view taken along the line VIII—VIII of FIG. 5.

Referring to FIG. 8, the carrier bars 39 and 41 are formed at their sides with racks 67 which are engaged by pinions 69 and 71, respectively, so as to be horizontally moved in the guide slots 35 and 37, respectively, in both the directions. The pinions 69 and 71 are each fixed to vertical shafts 73 which have sprockets 75 and 77, respectively, secured at the lower ends thereof. Also, each of the shafts 73 is freely rotatably journaled in bearings 79 in a sleeve 81 which is vertically disposed in a bore 83 vertically formed at the table 17 from the underside thereof and is fixed to the table 17 by a plurality of bolts 85. As shown in FIGS. 4 and 5, the sprockets 75 and 77 are simultaneously driven by means of a chain 87 by another sprocket 88 fixed to the output shaft of a motor 91 which is fixedly mounted on a bracket 92 fixed to the table 17. Thus, when the motor 91 is rotated together with the sprockets 89, the sprockets 75 and 77 are simultaneously rotated by means of the chain 87 to rotate the pinions 69 to move the carrier bars 39 and 41. Accordingly, the carrier bars 39 and 41 can be horizontally moved in both directions along the guide slots 35 and 37 by rotating the motor 91 normally or reversely to carry the die-set 27 rightwards or to return leftwards to their original positions after having carried the die-set 27.

As shown in FIG. 4, the table 17 is provided at its ends with stopper means 93, 95, 97 and 99 for regulating the movements of the carrier bars 35 and 37.

The stopper means 93 provided at the left-hand end of the guide slots 35 comprises a supporting member 101, an adjusting bolt 103, a sensing pin 105 and a limit switch 107. The supporting member 101 is fixed to the side of the table 17 corresponding to the left-hand end of the guide slot 35. The adjusting slot 103 is adjustably screwed through the supporting member 101 in such a manner as to finally positively stop the leftward movement of the carrier bar 39. The sensing pin 105 is horizontally slidably held by the supporting member 101 so that it may to touched by the carrier bar 39 brought back to the left-hand end of the guide slot 35. Also, the limit switch 107 is fixedly provided on a bracket 109 fixed to the left-hand side of the table 17 in a manner such that it will be actuated by the horizontally slidable sensing pin 101. Thus, when the carrier bar 39 is brought back to the left-hand end of the guide slot 35 into contact with the sensing pin 105, the limit switch 107 is actuated by the sensing pin 105 and stops the motor 91 from rotating, and as the result the carrier bars 39 and 41 are simultaneously stopped from going leftwards.

The stopper means 95 provided at the right-hand end of the guide slot 35 comprises a supporting member 111, first and second sensing pins 113 and 115 and first and second limit switches 117 and 119. The first and second sensing pins 113 and 115 are horizontally slidably held by the supporting member 111, and the first and second limit switches 117 and 119 are fixedly provided on a bracket 121 fixed to the right-hand side of the table 17 in such a manner as to be actuated by the first and second sensing pins 113 and 115, respectively. In the preferred embodiment, the first sensing pin 113 is so disposed as to be firstly touched by the carrier bar 39 coming near to the right-hand end of the guide slot 35, and the first limit switch 117 is so designed as to slow down the rotation of the motor 91 to decelerate the movement of the carrier bar 39 when actuated by the first sensing pin 113. On the other hand, the second sensing pin 115 is touched by the carrier bar 39 to actuate the second limit switch 119 after the first limit switch 117 has been firstly actuated by the first sensing pin 113 to slow down the rotation of the motor 91, and the second limit switch 119 is so designed as to stop the rotation of the motor 91 when actuated by the second sensing pin 115. It will be readily understood that the movements of the carrier bars 39 and 41 will be simultaneously decelerated and stopped when the rotation of the motor 91 is slowed down and stopped.

The stopper means 97 and 99 are provided at the left-hand and right-hand ends of the guide slot 37, respectively, so as to finally positively stop the movements of the carrier bar 41. The stopper means 97 comprises a supporting member 123 fixed to the left-hand side of the table 17 and an adjusting bolt 125 horizontally adjustably held by the supporting member 123, and the stopper means 99 comprises a supporting member 127 and an adjusting bolt 129 which are provided on the right-hand side of the table 17 in the same manner as the stopper means 97.

Referring to FIG. 4, a pair of guides plates 131 and 133 are fixed on the left-hand rear top of the table 17 at right angles with the guide slot 35 and in parallel with each other so as to guide the die-set 27 when it is brought out by the die advancing conveyor 9 onto the waiting position 29 of the table 17. Also, in order to easily slide the die-set 27 onto the working position 29, a plurality of rollers 135 are freely rotatably provided on elongate supporting members 137, 139, 141 and 143 which are disposed at right angles with the guide slots 35 and 37 on the left-hand top of the table 17. Furthermore, in order to position the die-set 27, a plurality of pins 145 and 147 are fixedly put on the top of the table 17 to define the waiting position 29, and a hydraulic motor 149 having a piston rod 151 provided at its end with a pushing member 153 is fixedly mounted on a suitable portion of the table 17. Thus, the die-set 27 is brought out from the die advancing conveyor 9 by the guide of the guide plates 131 and 133 and on the rollers 135 to the waiting position 29, and it is positively positioned at the waiting position 29 when it is pushed to the pins 145 and 147 by the pushing member 153 of the hydraulic motor 149. Also, limit switches 155 and 157 are so provided at the waiting position 29 as to be actuated by the die-set 27 when touched thereby. As will be detailedly described hereinafter, the limit switch 155 is so disposed as to put in motion a pushing means which is provided on the die advancing conveyor 9 to further move the die-set 27 forwardly when it is brought into the waiting position 29, while the limit switch 157 is so disposed as to work the hydraulic motor 149 and lower the supporting members 141 and 143 when the die-set 27 is to be positioned at the waiting position 29.

Figure 9:
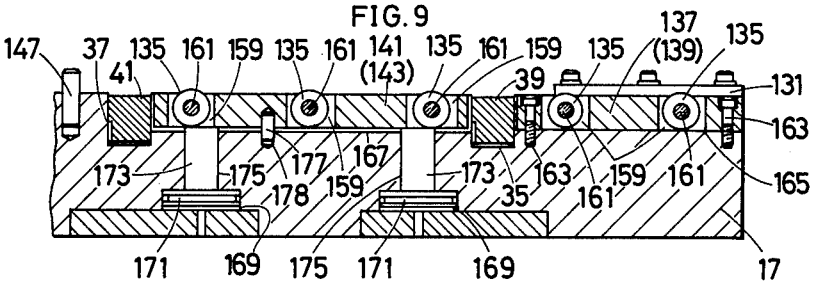
FIG. 9 is an enlarged sectional view taken for instance along the line IX—IX of FIG. 4.

As detailedly shown in FIG. 9, each of the supporting members 137, 139, 141 and 143 carrying the rollers 135 is rectangular in cross section, and it is formed with a plurality of horizontally elongated vertical slot 159 in which the rollers 135 are rotatably held by means of horizontally disposed shafts 161. Each of the supporting members 137 and 139 is fixedly placed by means of a plurality of bolts 163 in a slot 165 which is horizontally formed through the top of the table 17 rearward of the guide slot 35 at right angles therewith. On the other hand, each of the supporting members 141 and 143 is vertically movably placed in a slot 167 which is formed between the guide slots 35 and 37 at right angles therewith, and it is so designed as to be raised and lowered by a plurality of hydraulic motors each comprising a hydraulic cylinder 169 having a piston 171 and a piston 173 and mounted therebeneath. The piston rods 173 of the hydraulic cylinders 169 are vertically disposed to touch and hold the bottoms of the supporting members 141 and 143 through vertical bores 175 formed through the table 17. Also, in order to prevent the horizontal movements of the supporting members 141 and 143, pins 177 are vertically fixedly provided at the bottoms of the supporting members 141 and 143 in such a manner as to depend downwardly to vertically slidably fit in bores 178 vertically formed through the table 17. Thus, the supporting members 137 and 139 are so designed as to be raised and held flush with the supporting members 141 and 143 by the piston rods 173 of the hydraulic cylinders 169 to enable the die-set 27 to easily move on the rollers 135 to be positioned. Also, when the supporting members 141 and 143 are lowered by the piston rods 173 to make the rollers 135 sink from the top of the table 17, the die-set 27 having been brought onto them at the waiting position 29 is directly placed on the top of the table 17. In this connection, the piston rods 173 of the hydraulic cylinder 169 are worked to lower the supporting members 141 and 143 together with the rollers 135, when the die-set 27 is brought into contact with the limit switch 157.

From the above description, it will now be understood that the die-set 27 is firstly brought out onto the rollers 135 from the die advancing conveyor 9 and placed at the waiting position 29 on the table 17 and then carried rightwards to the working position 31 by the carrier bars 39 and 41.

As shown in FIGS. 4 and 5, a plurality of pairs of guide plates 179 are fixedly provided on the top surface of the table 17 to guide the die-set 27 being carried by the carrier bars 39 and 41 from the waiting position 29 to the working position 31 which are located just under the ram 15 of the press 1. Also, a plurality of lower die holding means 181 are provided on the central portion of the table 17 to clamp the lower die of the die-set 27 at the working position 31.

Figure 10:
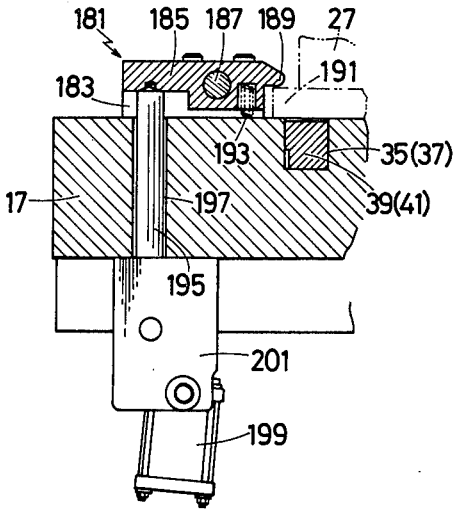
FIG. 10 is an enlarged partially sectional view taken for instance along the line X—X of FIG. 4.

As detailedly shown in FIGS. 5 and 10, each of the lower die holding means 181 comprises a pair of square blocks 183 fixed perpendicular to the guide slots 35 and 37 and a clamping member 185 is pivoted between the blocks 183 by means of a horizontal pin 187. The clamping member 185 is formed at its end with a clamping jaw 189 for clamping a portion 191 of the lower die of the die-set 27 to the top surface of the table 17. In order to enable the die-set 27 to be put into the lower die holding means 181, a spring 193 is provided between a portion of the clamping member 185 near the clamping jaw 189 and the top surface of the table 17 to bias the clamping jaw 189 upwardly about the pin 187. Also, in order to enable the clamping jaw 189 to clamp the die-set 27, the clamping member 185 is so designed as to be swung around the pin 187 against the spring 193 by a rod 195 which is vertically slidably fitted in a bore 197 formed through the table 17. The rod 195 is so provided as to be driven upwardly to swing the clamping member 185 upwardly by a hydraulic motor 199 which is mounted on a bracket 201 fixed to any suitable portion of the underside of the table 17. Thus, the lower die holding means 181 will clamp the die-set 27 at the working position 31 when the rod 195 is raised upwardly by the hydraulic motor 199. Also, the die-set 27 can be put into and taken out of the lower die holding means 181 when the rod 195 is not worked by the hydraulic motor 199, since the clamping jaw 189 will be upwardly biased by the spring 193.

From the above description, it will be readily apparent that each of the lower die holding means 181 will automatically clamp or release the die-set 27 when the hydraulic motor 199 is worked. All the lower die holding means 181 are the same in construction and function and are simultaneously worked to clamp the same die-set 27.

According to the present invention, the press 1 is equipped also with a plurality of upper die holding means 203 for holding the upper portion or upper die of the die-set 27. As shown in FIG. 1, such upper die holding means 203 are mounted on the ram 15 of the press 1, and although two upper die holding means 203 are shown as symmetrically mounted on the front portion of the ram 15 in FIG. 1, two more may be provided at the rear portion of the ram 15 in the similar manner.

Figure 11:
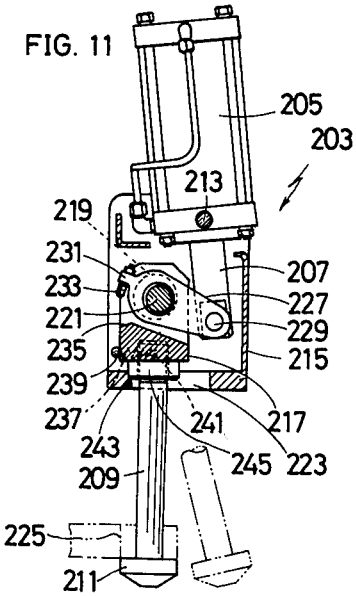
FIG. 11 is an enlarged partially sectional view taken for instance along the line XI—XI of FIG. 1.

As detailedly shown in FIG. 11, each of the upper die holding means 203 comprises a pivotally movable hydraulic cylinder or motor 205 having a piston rod 207 and an eccentrically driven holding rod 209 provided at its end with a flanged holding member 211 for holding the die-set 27. The hydraulic motor 205 is pivotally supported on a pin 213 horizontally fixed to a bracket 215 which is fixedly mounted on the ram 15 of the press 1. The holding rod 209 is integrally fixed to an eccentrically movable member 217 which is freely rotatably supported on an eccentric 219 which is shown in FIG. 11 by the dotted circular line. The eccentric 219 is integrally fixed to a horizontal shaft 221 which is freely rotatably supported by the bracket 215. Also, the holding rod 209 is disposed to depend downwardly from the eccentric 219 through an elongated opening 223 formed at the lower portion of the bracket 215 so that the flanged holding member 211 of the holding rod 209 may hook and hold a portion 225 of the upper die of the die-set 27. In order to rotate the shaft 221 and the eccentric 219, a lever 227 is integrally fixed to the shaft 221 and its end is pivotally connected by means of a pin 229 with the end of the piston rod 207 of the hydraulic cylinder 205. Thus, when the piston rod 207 is extended out of or retracted into the hydraulic motor 205, the eccentric will be rotated together with the shaft 221 by the lever 227 and will eccentrically raise or lower the eccentrically movable member 217 and consequently the holding rod 209 keeping them vertical. In order to not only eccentrically raise and lower the holding rod 209 but also swing it around the eccentric 219, the lever 227 is provided at its end 231 opposite to the pin 229 with a pushing member 233 and the eccentrically movable member 217 is formed at its portion with an abutment shoulder 235. The arrangement is that the pushing member 233 will be brought into contact with the abutment shoulder 235 to push and rotate the same around the eccentric 219 when the piston rod 207 is retracted and the lever 227 is rotated around the shaft 221 to lower the pushing member 233. Also, a spring 237 is provided between pins 239 and 241 fixed to the bracket 215 and the eccentrically movable member 217, respectively, to bias the holding rod 209 towards the die-set 27 to be held. Furthermore, the end 243 of the elongated opening 223 nearer to the die-set 27 to be held is so provided as to stop an abutment member 245 provided at the upper portion of the holding rod 209 and hold the holding rod 209 usually vertical.

From the above description, it will be now apparent that each of the upper die holding means 203 will automatically hold or release the upper portion or upper die of the die-set 27 when the hydraulic motor 205 is worked. When the piston rod 207 of the hydraulic motor 205 is retracted, the lever 227 will make the eccentric 219 to lower the holding rod 209 and also make the pushing member 233 to swing the holding rod 209 as shown by the imaginary lines in FIG. 11. As the result, the holding rod 209 will be made ready for holding the die-set 27 or will release the same having been held between the flanged holding member 211 and the underside of the ram 15. Also, when the piston rod 207 is extended, the pushing member 233 will be rotated upwardly around the shaft 221 to enable the holding rod 209 to be swung back by the spring 237 into contact with the die-set 27 and also the eccentric 219 will raise the holding rod 209 to hold the portion 225 of the die-set 27 between the flanged holding member 211 and the underside of the ram 15. All the upper die holding means 203 are the same in construction and function and are simultaneously worked to hold the same die-set 27.

Referring again to FIGS. 4 and 5, the die-set 27 after being released from the lower and upper die holding means 181 and 203 at the working position 31 is carried by the carrier bars 39 and 41 rightwards on the table 17 to the retiring position 33 and then transferred to the die returning conveyor 3. For this purpose, there are provided at the retiring position 33 a plurality of rollers 247 freely rotatably supported on supporting members 249, 251, 253 and 255 and a hydraulic motor 257 for pushing the die-set 27 to the die returning conveyor 3. The supporting members 249 and 251 for supporting the rollers 247 are fixed at the table 17 in the same manner as the supporting members 137 and 139 at the waiting position 29, and the supporting members 253 and 255 are vertically movably provided in all the same manner as the supporting members 141 and 143 at the waiting position. Also, the hydraulic motor 257 is fixedly mounted on the top of the table 17 forward of the guide slot 37 and at right angles therewith, and it is so arranged as to push the die-set 27 toward the die returning conveyor 3 after the supporting members 253 and 255 have been raised by hydraulic motors 259 provided there-beneath in the same manner as the supporting members 141 and 143 at the waiting position 29.

Referring now to FIGS. 3, 12, 13 and 14, the die returning conveyor 3 is of a frame 261 which is constructed of a plurality of posts 263, a plurality of lower beams 265 connecting lower portions of the posts 263 and a plurality of upper beams 267 connecting upper portions of the posts 263.

Figure 12:
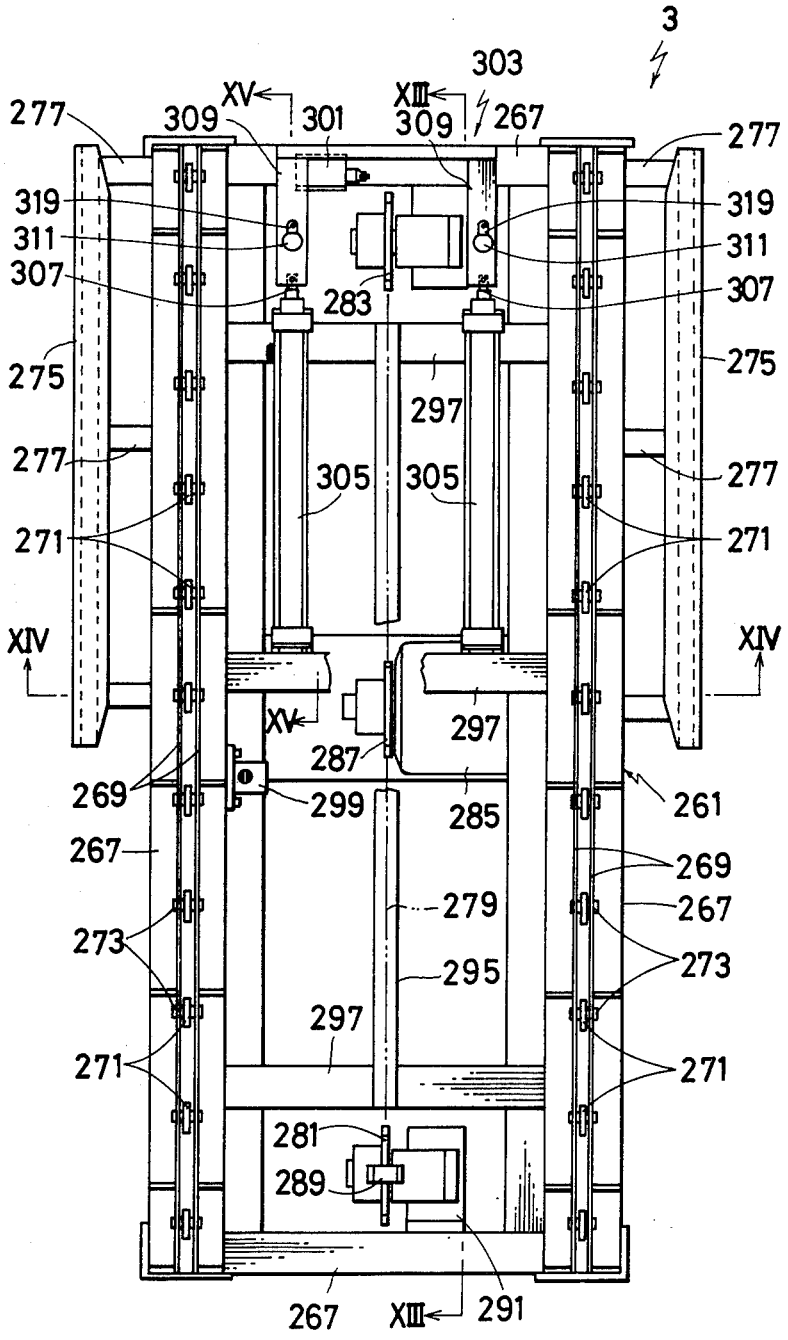
FIG. 12 is an enlarged partial plan view of the apparatus corresponding to the right-hand portion of FIG. 3.
Figure 13:
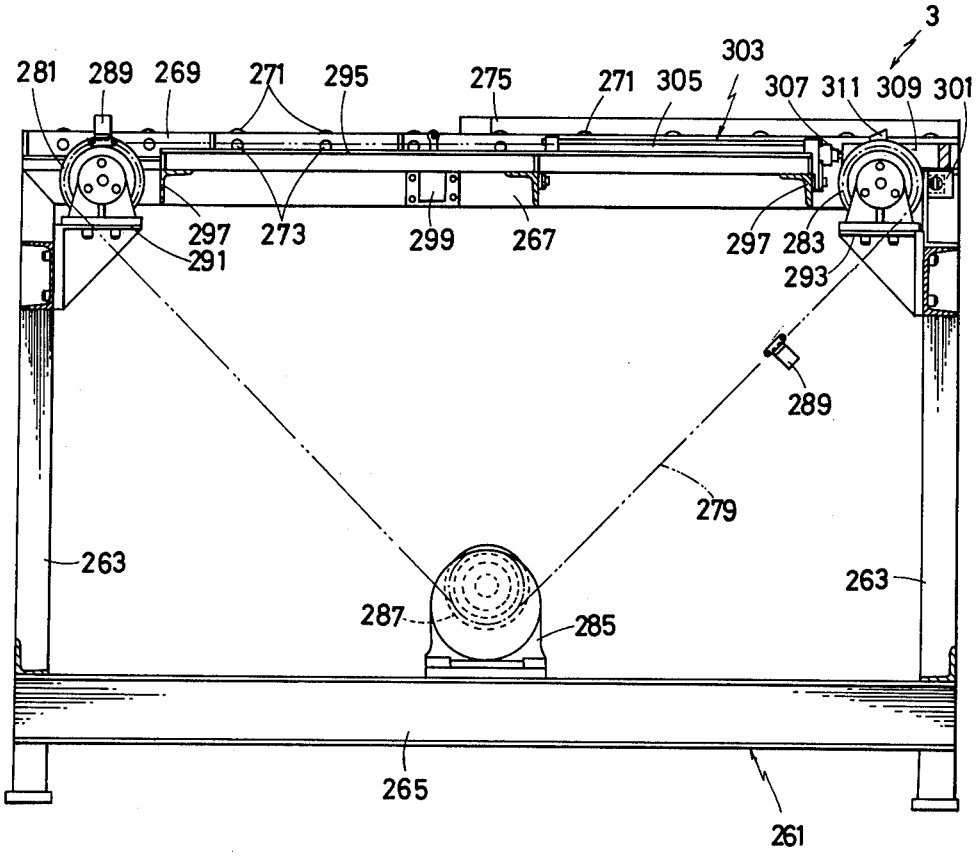
FIG. 13 is a side sectional view taken along the line XIII—XIII of FIG. 12.
Figure 14:
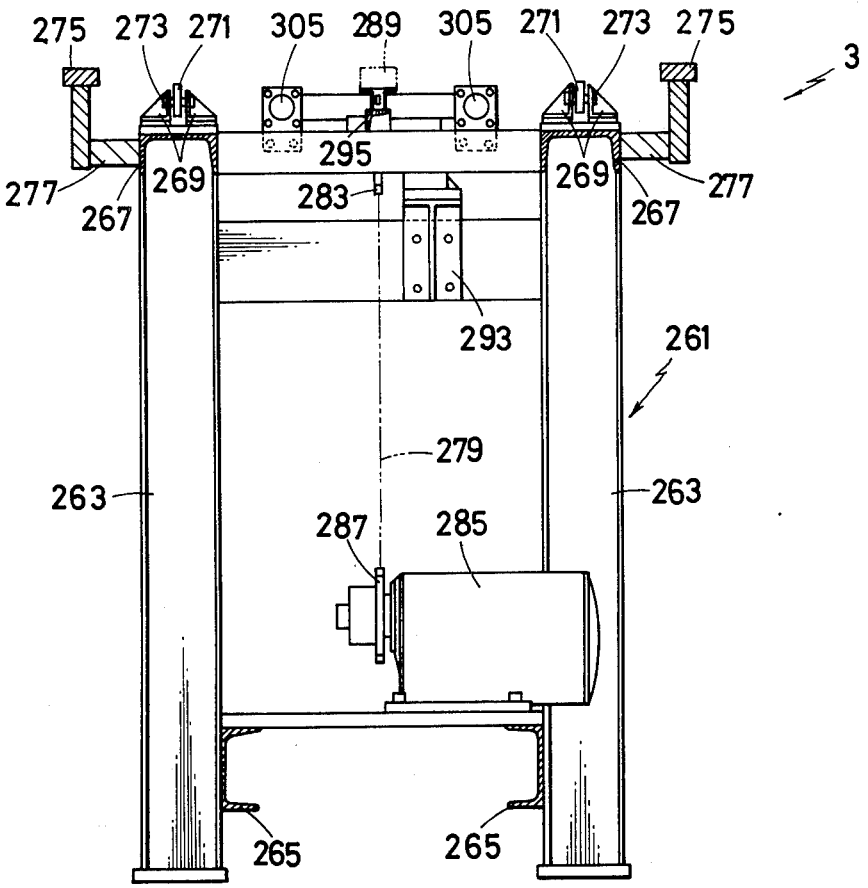
FIG. 14 is a front sectional view taken along the line XIV—XIV of FIG. 12.

As best shown in FIG. 12, a pair of elongated roller supporting members 269 supporting a plurality of rollers 271 by means of shafts 273 are horizontally symmetrically mounted on both sides of the top of the frame 261 in such a manner as to be perpendicular to the table 17 and in parallel with each other. Also, a pair of guide plates 275 are horizontally symmetrically mounted on both sides of the frame 261 on a plurality of brackets 277 which are horizontally fixed to the sides of the upper beams 267. Thus, the die-set 27, which has been brought onto the die returning conveyor 3 from retiring position 33 of the table 17 by the hydraulic motor 257, is carried rearward on the rollers 269 by the guide of the guide plates 275.

In order to convey the die-set 27 rearwards, a chain 279 is trained around front and rear sprockets 281 and 283 provided at the front and rear upper portions, respectively, of the die returning conveyor 9 to be driven by a motor 285 through another sprocket 287, and it is provided with a plurality of pushing members 289 for pushing the die-set 27. The front and rear sprockets 281 and 283 are freely rotatably supported on front and rear brackets 291 and 293, respectively, fixed to the front and rear upper beams 267, respectively, in such a manner as to horizontally stretch the chain 279 along the center between the roller supporting members 269. The motor 285 for driving the chain 279 by means of the sprocket 287 is mounted on the lower beams 265 in a manner such that the sprocket 287 is located just beneath the upper stretch of the chain 279 horizontally stretched between the front and rear sprockets 281 and 283. Also, in order to stop the horizontal stretch of the chain 279 from sagging or swaying downwardly between the front and rear sprockets 281 and 283, an elongated plate 295 is horizontally fixed on a plurality of horizontal supporting beams 297 spanned between the right-hand and left-hand upper beams 267 in such a manner as to be located just beneath the horizontal stretch of the chain 279. Furthermore, limit switches 299 and 301 are provided at a rather front portion and a rearmost portion, respectively, of the way of the die-set 27 so that they may be actuated by the die-set 27 and the pushing member 289, respectively. The limit switch 299 is so disposed as to retract the piston rod of the hydraulic motor 257 mounted on the table 17 for pushing the die-set 27 rearwards and also lower the front supporting members 253 and 255 supporting the rollers 247 when the die-set 27 has been completely brought into the die returning conveyor 3. The limit switch 301 is provided to stop the motor 285 for driving the chain 279 and put in motion a die pushing means 303 provided at the rather rear portion of the die returning conveyor 3 when it is actuated by the pushing member 289.

Figure 15:
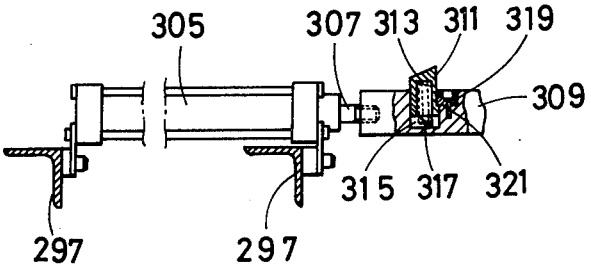
FIG. 15 is an enlarged sectional view taken for instance along the line XV—XV of FIG. 12.

The die pushing means 303 for pushing the die-set 27 from the die returning conveyor 3 onto the die transferring carriage 5 comprises a plurality of hydraulic motors 305 each having a piston rod 307 which are mounted on the supporting beams 297 of the frame 261 in parallel with the horizontal upper stretch of the chain 279. Each of the piston rods 307 of the hydraulic motors 305 is disposed to horizontally extend rearwards, and it is connected at its end with a pushing member 309 which is horizontally slidably mounted on the top portion of the die returning conveyor 3. Also, each of the pushing members 309 of the die pushing means 303 has a catch member 311 which is provided to directly push the die-set 27 rearwards and is of a cylindrical shape having at its top a slope 313 descending forwardly. As detailedly shown in FIG. 15, each of the catch members 311 is vertically slidably inserted in a bore 315 vertically formed at the pushing member 311, and it is upwardly biased by a spring 317 to project from the top surface of the pushing member 309 to push the die-set 27. Also, each of the catch members 311 is stopped from jumping out by a stop member 319 fixed by a bolt 321 to the pushing member 311 in a manner such that the lowermost portion of its slope 313 is kept flush with or lower than the top surface of the pushing member 309. Thus, the catch members 311 of the pushing members 309 will be depressed from the top surfaces of the pushing members 309 when the die-set 27 is being moved on the pushing members 309 by the pushing member 289 of the chain 279, but they will be projected out by the springs 317 to push the die-set 27 rearwards after the die-set 27 has passed away thereover.

Thus, it will be now understood that the die-set 27 having been brought to the rearward portion of the die returning conveyor 9 by the chain 279 is pushed further rearwards to the die transferring carriage 5 by the hydraulic motors 305 by means of the pushing members 309 and the catch members 311. As has been described hereinbefore, the hydraulic motors 305 of the die pushing means 303 are put in motion to enable the pushing members 309 and the catch members 311 to push the die-set 27 when the limit switch 301 is actuated by the pushing member 289 of the chain 279. Also, when the limit switch 301 is actuated, the motor 285 is stopped from driving the chain 279. Also, it will be readily apparent to one skilled in the art that a single hydraulic motor or pnematic motor can be used for the die pushing means 303 although the two hydraulic motors 305 is employed in the preferred embodiment.

Referring to FIGS. 3, 16, 17 and 18, the die transferring carriage 5 is of a frame 323 which is constructed of a plurality of posts 325 and beams 327 horizontally connecting the posts 325, and it has a plurality of wheels 329 having shafts 331 which are fixed to the base bars 333 horizontally fixed to lowermost portions of both sides of the frame 323. Also, the die transferring carraige 5 is movably mounted on rails 335 which are fixedly mounted on a base plate 337 in a manner such that it will be horizontally moved in parallel with the guide slots 35 and 37.

Thus, the die transferring carriage 5 is moved behind the press 1 and the die returning and advancing conveyors 3 and 9 and in front of the die stocking rack 7 to transfer the die-set 27 from the die returning conveyor 3 to desired portions of the die stocking rack 7 and from the die stocking rack 7 to the die advancing conveyor 9.

Figure 18:
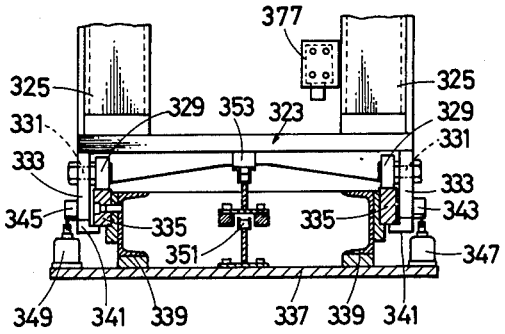
FIG. 18 is a side sectional view taken along the line XVIII—XVIII of FIG. 16 with portions thereof omitted and broken away for clarity.
Figure 19:
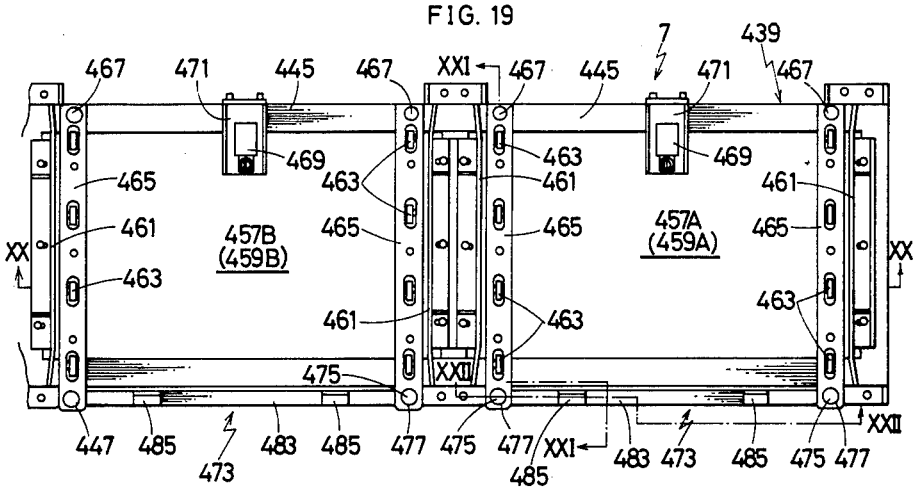
FIG. 19 is an enlarged partial plan view of the apparatus corresponding to the rearmost portion of FIG. 3.
Figure 20:
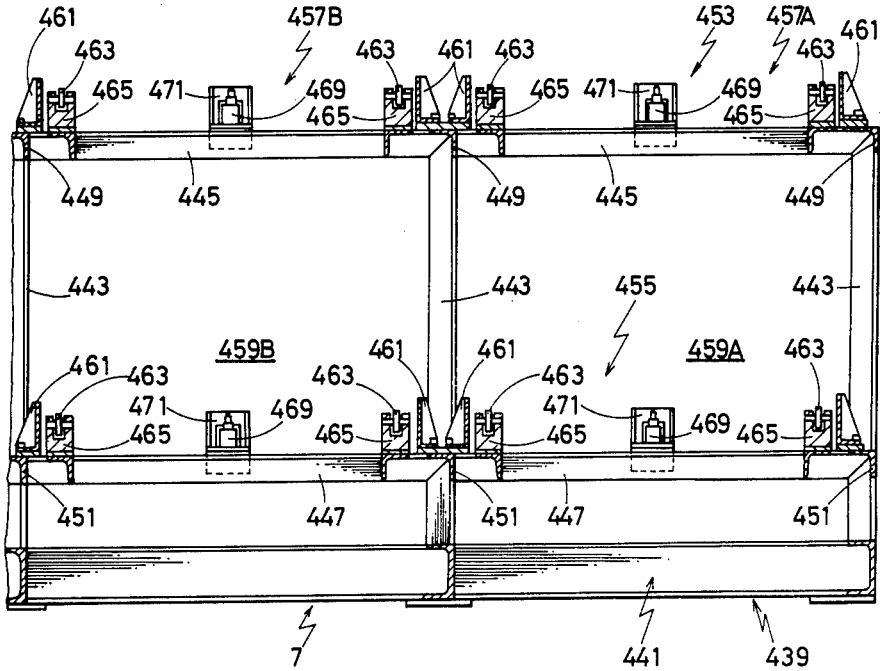
FIG. 20 is a front sectional view taken along the line XX—XX of FIG. 19.
Figure 21:
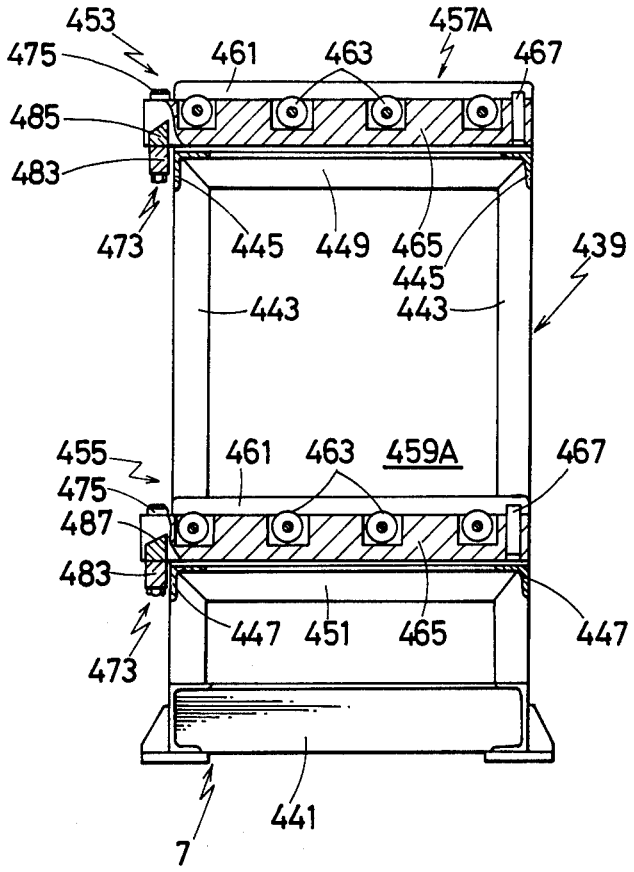
FIG. 21 is a side sectional view taken along the line XXI—XXI of FIG. 19.

As shown in FIG. 18, in order to prevent the die transferring carriage 5 from derailing and shaking, the rails 335 are elevatedly supported by elongated supporting beams 339 on the base plate 337 and holding members 341 are fixed to the base bars 337 so as to slidably hold the undersides of the rails 335 in the preferred embodiment. Also, dogs 343 and 345 are fixed to the side portions of the base bars 337 so as to actuate limit switches 347 and 349, respectively, which are provided on the base plate 337 by the sides of the die transferring carriage 5. The limit switches 347 are actuated to slow down the movement of the die transferring carriage 5, when it is brought near desired portions of the die stocking rack 7, while the limit switches 349 is actuated to stop the die transferring carriage 5 at desired positions with regard to the die stocking rack 7.

Figure 17:
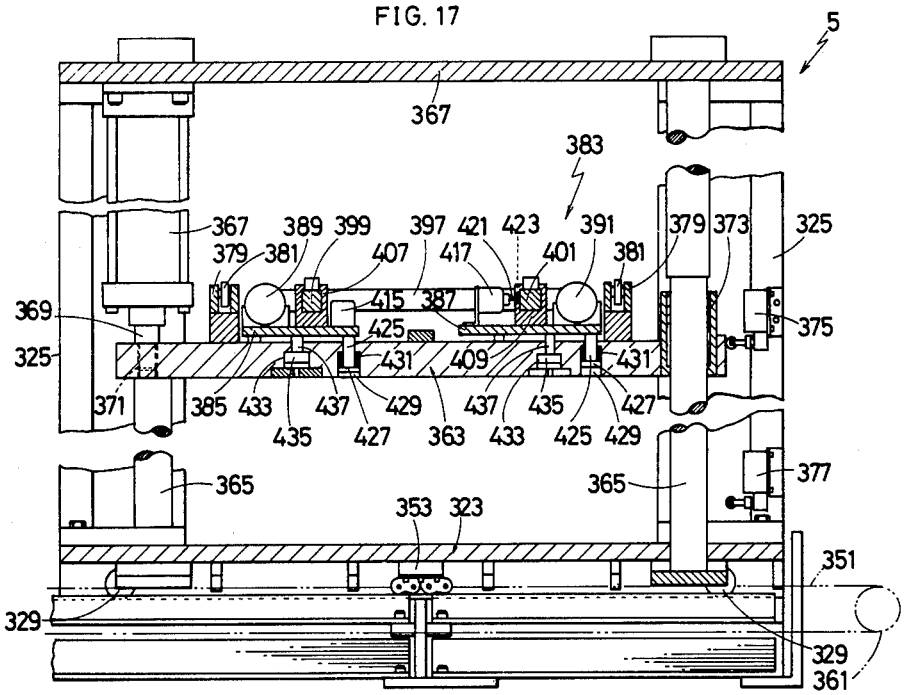
FIG. 17 is a front sectional view taken along the line XVII—XVII of FIG. 16, with portions thereof omitted and broken away for clarity.

In order to move the die transferring carriage 5 on and along the rails 335 in both directions, a chain 351 is connected at its both ends to a bracket 353 dependingly fixed to the bottom of the die transferring carriage 5, as shown in FIG. 17. Also, the chain 351 is trained around a sprocket 355 which is freely rotatably supported on a bracket 357 mounted on an end of the base plate 337 and is driven by a motor 359 shown in FIG. 3 by means of a sprocket 361 which is shown by the imaginary line in FIG. 17.

As best shown in FIG. 17, an elevating carrier means 363 is vertically movably provided in the frame 323 of the die transferring carriage 5 to transfer the die-set 27 from the die returning conveyor 3 to the die stocking rack 7 and from the die stocking rack 7 to the die advancing conveyor 9. The elevating carrier means 363 is vertically slidably mounted on a plurality of guide posts 365 which are vertically fixed at each corner of the frame 323 and are vertically held at their top ends by the upper beams 327 of the frame 323. Also, in order to raise and lower the elevating carrier means 363 along the guide posts 365, a plurality of hydraulic motors 367 having piston rods 369 are so provided as to depend downwardly from the upper beams 327 and their piston rods 369 are screwed at their lower ends into threaded bores 371 formed on the top surface of the base plate of the elevating carrier means 363. Also, the elevating carrier means 363 is so constructed as to vertically slide along the guide posts 365 by means of slide bushes 373 which are provided in such a manner as to slidably hold the guide posts 365. Thus, the elevating carrier means 363 is vertically moved to any desired elevational positions by the hydraulic motors 367, and it is so designed as to be stopped at two elevational positions in the preferred embodiment. Accordingly, two limit switches 375 and 377 are provided at suitable portions of the frame 323 so as to stop the elevating carrier means 363 from vertically moving when touched thereby.

Figure 16:
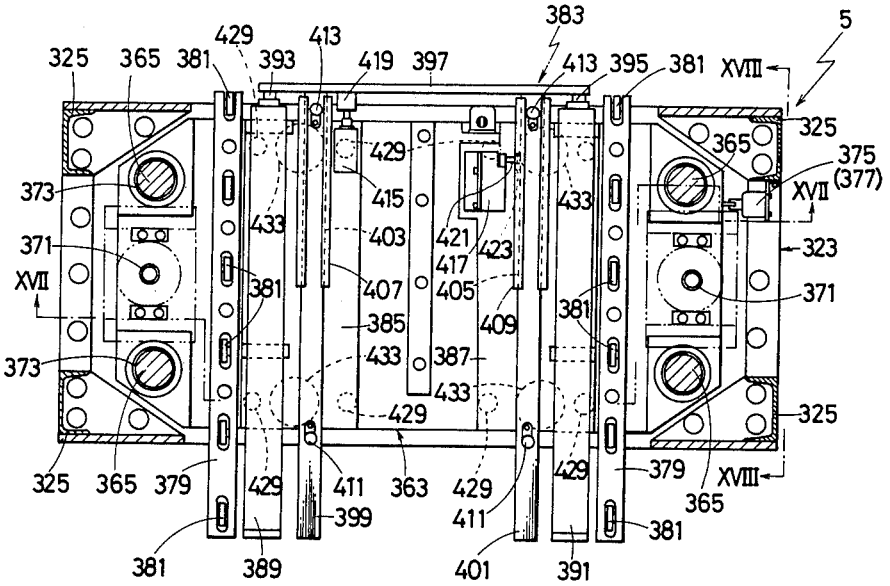
FIG. 16 is an enlarged partial plan view of the apparatus corresponding to the rather rear portion of FIG. 3.

As shown in FIGS. 16 and 17, there are provided on the top of the elevating carrier means 363 a plurality of roller supporting members 379 supporting a plurality of rollers 381 on which the die-set 27 is moved towards and away from the die stocking rack 7. Also, a die moving means 383 is provided on the elevating carrier means 363 so as to move the die-set 27 on the rollers 381 towards and away from the die stocking rack 7.

The die moving means 383 comprises vertically movable supporting plates 385 and 387 and hydraulic motors 389 and 391 which have piston rods 393 and 395, respectively, and are horizontally mounted in parallel with each other on the supporting plates 385 and 387, respectively. The piston rods 393 and 395 of the hydraulic motors 389 and 391 are horizontally extendable rearwards and are integrally connected at their ends with each other by a horizontal connecting plate 397. A pair of elongated pushing members 399 and 401 are horizontally and integrally fixed to the front side of the connecting plate 397 at right angles therewith and in parallel with the piston rods 393 and 395 so that they may be horizontally moved by the piston rods 393 and 395 by means of the connecting plate 397. The pushing members 399 and 401 are provided to push the die-set 27 towards and away from the die stocking rack 5 and they are slidably put in elongated guide slots 403 and 405, respectively, formed through elongated supporting blocks 407 and 409, respectively, which are fixedly placed on the vertically movable supporting plates 385 and 387, respectively. Also, the pushing members 399 and 401 are provided at their front and rear portions with front and rear catch members 411 and 413 which are provided to directly push the die-set 27 and are all the same in function and construction as the catch members 311 of the die returning conveyors 3 shown in FIGS. 12, 13 and 15. Each of the front catch members 411 is formed at its top with a slope descending forwardly and are designed to push the die-set 27 towards the die stocking rack 7, while each of the rear catch members 413 having a slope descending rearwardly is disposed to push the die-set 27 away from the die stocking rack 7. Thus, when the piston rods 393 and 395 of the hydraulic motors 389 and 391 are moved to move the connecting plate 397, the pushing members 399 and 401 are simultaneously moved to enable the catch members 411 and 413 to push and move the die-set 27 on the rollers 389. Also, as will be described hereinafter, the pushing members 399 are so designed as to be almost fully extended into the die stocking rack 7 to carry the die-set 27 into and out of the die stocking rack 7 when the piston rods 393 and 395 are fully extended from the hydraulic motors 389 and 391.

As shown in FIGS. 16 and 17, limit switches 415 and 417 are provided on the die moving means 383 of the die transferring carriage 5. The limit switch 415 is so provided as to be actuated by a dog 419 which is fixed to the connecting plate 397 when the connecting plate 397 and the pushing members 399 and 401 are brought back to their original positions from the die stocking rack 7. Thus, when the limit switch 415 is actuated, the motor 359 shown in FIG. 3 can be put in motion to move the die transferring carriage 5 along the rails 335. Also, the limit switch 417 is fixed by the side of the supporting block 409 in the preferred embodiment and is so designed as to be actuated by means of an actuating member 421 which is kept in contact with the pushing member 401 through an opening 423 formed through the supporting block 409. The limit switch 417 is actuated when the pushing member 401 has passed away out of contact with the actuating member 421 to carry the die-set 27 completely into the die stocking rack 7. Thus, when the limit switch 417 is actuated, the vertically movably supporting plates 385 and 387 may be lowered in a manner to be described hereinafter.

Both of the vertically movable supporting plates 385 and 387 are so disposed as to be usually kept lowered and they are raised when the pushing members 399 and 401 are to be worked to move the die-set 27. As shown in FIGS. 16 and 17, both of the vertically movable supporting plates 385 and 387 are held by a plurality of vertically movable holding rods 425 which are fixed to the bottoms of the supporting plates 385 and 387 and are formed at their lower ends with flanges 427. The holding rods 425 are vertically slidably put in vertical bores 429 which are formed through the base plate of the elevating carrier means 363 and formed larger at their lower portions so as to enable the flanges 427 of the holding rods 425 to vertically slide therein. Also, the holding rods 425 are downwardly biased by helical springs 431 by means of the flanges 427 so that the vertically movable supporting plates 385 and 387 will be usually kept positively lowered. On the other hand, both of the vertically movable plates 385 and 387 are so designed as to be raised by a plurality of hydraulic motors 433 which comprise pistons 435 having piston rods 437 and are mounted on the lower portions of the base plate of the elevating carrier means 363. The piston rods 435 of the hydraulic motors 433 are projected upwardly through bores vertically formed through the base plate of the elevating carrier means 363 and are made to contact or connected with the bottoms of the vertically movable supporting plates 385 and 387.

As will be described hereinafter, the vertically movable supporting plates 385 and 387 are raised by the hydraulic motors 433 when the pushing members 399 and 401 and their catch members 411 and 413 are worked to carry the die-set 27 into or out of the die stocking rack 7. Also, the vertically movable supporting plates 385 and 387 are kept lowered by the springs 431, when the pushing members 399 and 401 are at their original positions on the elevating carrier means 363 and when they are extended into or retracted out of the die stocking rack 7 without carrying the die-set 27 before catching the die-set 27 to be taken out or after having placed the die-set 27 in the die stocking rack 7.

Referring to FIGS. 3, 19, 20 and 21, the die stocking rack 7 is of a longish frame 439 and is placed rearward of the die transferring carriage 5 in parallel with the rails 335 thereof. The frame 439 of the die stocking rack 7 is constructed of a base 441, a plurality of posts 443 vertically fixed to the base 441, upper and lower beams 445 and 447 horizontally connecting the posts 443 lengthwise and uppwer and lower beams 449 and 451 horizontally connecting the posts 443 breadthwise. Thus, the die stocking rack 7 is of upper and lower stories 453 and 455 and is compartmentalized into plurality of upper and lower die stocking shelves 457A and 457B and 459A and 459B for stocking the die-set 27, which are almost the same in function and construction. It is apparent to those skilled in the art that any number of die stocking shelves 457A, 457B, 459A and 459B can be provided.

Each of the die stocking shelves 457A, 457B, 459A and 459B of the die stocking rack 7 is provided at both its sides with a pair of guide plates 461 horizontally fixed to the upper or lower beam 449 or 451 and also a plurality of rollers 463 freely rotatably supported on a pair of supporting members 465 which are fixedly spanned between the upper or lower beams 445 and 447. It will be readily seen that the rollers 463 are aligned in parallel with the direction of the movement of the pushing members 399 and 401 of the die transferring carriage 5 and also the guide plates 461 are provided outside of the rollers 463 in parallel with the roller supporting members 465. Thus, the die-set 27 can be moved on the rollers 463 by the guide of the guide plates 461 forwards and rearwards namely towards and away from the die transferring carriage 5. Also, each of the roller supporting members 465 is provided at its rear end with a projecting stop member 467 for stopping the rearward movement of the die-set 27 on the rollers 465. Furthermore, limit switches 469 are provided on brackets 471 in all the die stocking shelves 457A, 457B, 459A and 459B so as to be actuted by the die-set 27. Each of the limit switches 469 is so designed as to indicate or signal the presence of any die-set 27 in the particular die stocking shelf 457A, 457B, 459A or 459B so as to stop another die-set 27 from being brought into the same die stocking shelf.

Figure 22:
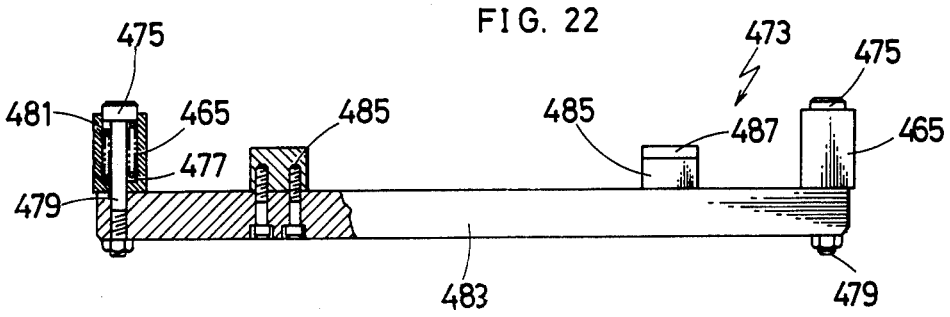
FIG. 22 is an enlarged sectional view taken for instance along the line XXII—XXII of FIG. 19.
Figure 23:
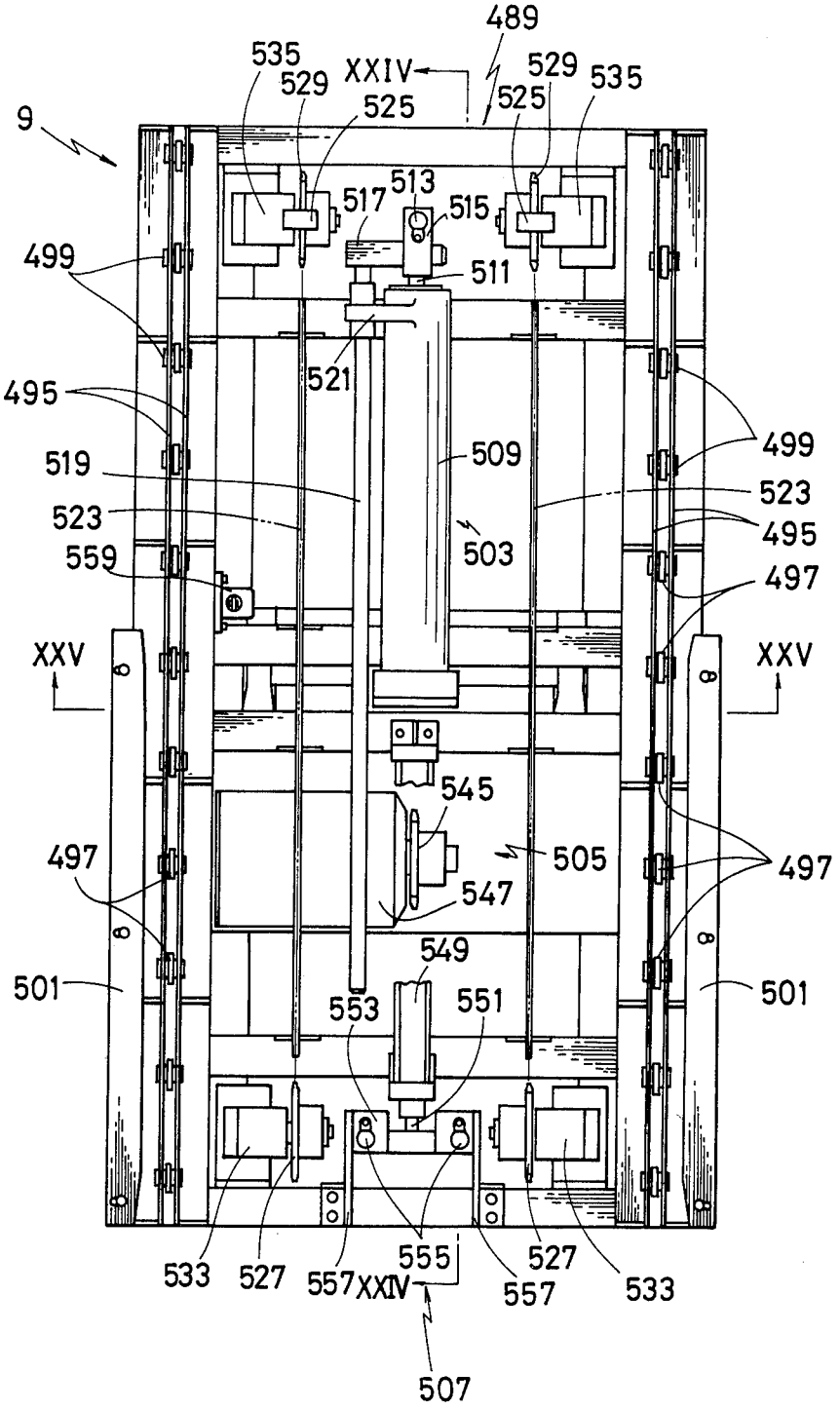
FIG. 23 is an enlarged partial plan view of the apparatus corresponding to the left-hand portion of FIG. 3.
Figure 24:
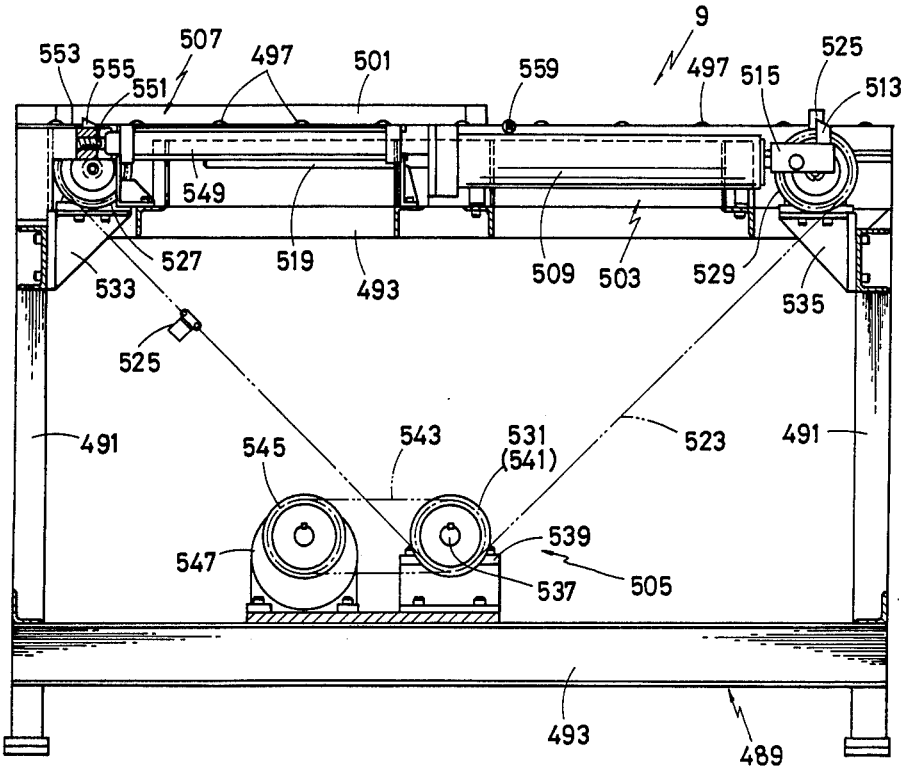
FIG. 24 is a side sectional view taken along the line XXIV—XXIV of FIG. 23.
Figure 25:
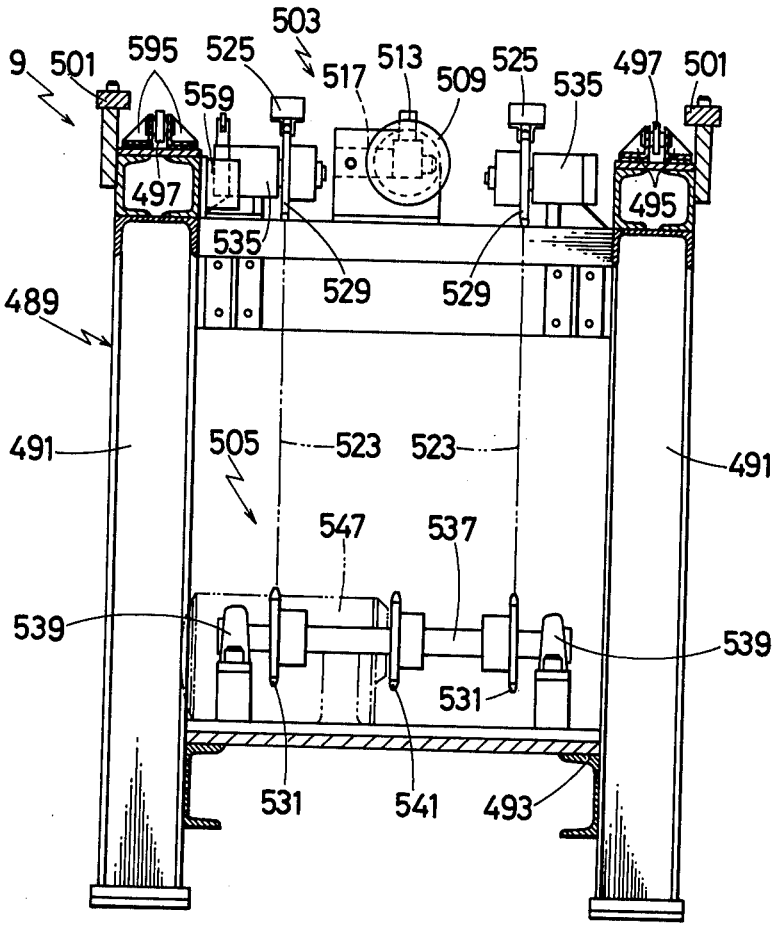
FIG. 25 is a front sectional view taken along the line XXV—XXV of FIG. 23.

Each of the die stocking shelves 457A, 457B, 459A and 459B of the die stocking rack 7 is provided at its front portion with a die stopping means 473 for stopping the die-set 27 stocked in the particular die stocking shelf from moving therefrom of itself. As detailedly shown in FIG. 22, the die stopping means 473 comprises a pair of cylindrical stopping members 475 which are vertically slidably put in vertical bores 477 formed at the front ends of the roller supporting members 465. Each of the stopping members 475 is formed at its lower portion with a stem-like portion 479 smaller in diameter and it is upwardly biased by a helical spring 481 surrounding the stem-like portion 479 so that it may usually project upwardly from the top of the roller supporting member 465. Thus, the stopping members 475 will stop the die-set 27 stocked on the rollers 463 in the die stocking shelves 457A, 457B, 459A and 459B from moving forwardly therefrom. The lower ends of the stopping members 475 of each of the die stopping means 473 are made to slidably extend downwardly through smaller bores formed at the bottoms of the bores 477 and are fixedly connected to a horizontal bar 483 which is spanned between the front ends of the roller supporting members 465. Also, a pair of blocks 485 formed at their tops with slopes 487 descending forwardly are fixed on the top of the horizontal bar 483 so that they may be touched by the pushing members 399 and 401 of the die transferring carriage 5. Thus, when the pushing members 399 and 401 are extended from the die transferring carriage 7 into contact with the slopes 487 of the blocks 485, they will downwardly depress the horizontal bar 483 against the springs 481 to sink the stopping members 475 downwardly into the bores 477. In the above described manner, the stopping members 475 of the stopping means 473 are usually kept projected by the springs 481 from the tops of the roller supporting members 465 and they will be sunk therefrom to enable the die-set 27 to move on the rollers 463 when the die-set 27 is to be brought into or out of the die stocking shelves 457A, 457B, 459A and 459B.

Referring now to FIGS. 3, 23, 24 and 25, the die advancing conveyor 9 is of a frame 489 which is constructed on a plurality of posts 491 and a plurality of beams 493. Just in the same manner as the die returning conveyor 3, the frame 489 of the die advancing conveyor 9 is provided at its top with a pair of roller supporting members 495 on which a plurality of rollers 497 are freely rotatably supported by means of shafts 499 to enable the die-set 27 to move thereon. Also, a pair of guide plates 501 are horizontally fixed outside of the rollers 497 on both sides of the frame 489 so as to guide the die-set 27 to be moved on the rollers 497.

Roughly stated here, the die advancing conveyor 9 is provided with a die taking means 503 for taking the die-set 27 from the die transferring carriage 7, a die carrying means 505 for carrying the die-set 27 forwardly and a die pushing means 507 for pushing out the die-set 27 forwardly to the waiting position 29 of the table 17.

The die taking means 503 is provided on the rear top of the frame 489 and comprises a hydraulic motor 509 having a rearwards extendable piston rod 511 and a catch member 513 provided on a rectangular block 515 which is integrally fixed to the end of the piston rod 511. The catch member 513 is provided on the rectangular block 515 in the same manner as the catch members 311 of the die pushing members 303 in the die returning conveyor 3 which is detailedly shown in FIG. 15. In order to prevent the catch member 513 from rotating together with the piston rod 511 about the radial center of the hydraulic motor 509, another block 517 is integrally fixed to the rectangular block 515, and a slide bar 519 is horizontally fixed to the block 517 in parallel with the piston rod 511 and is slidably held by a projection 521 formed on the hydraulic motor 509. Thus, the catch member 513 is so designed as to be extended by the piston rod 511 into between the vertically movable supporting plates 385 and 387 in the die transferring carriage 5 to catch the lower rear end of the die-set 27 carried therein. Also, the catch member 513 will pull out the die-set 27 from the die transferring carriage 5 onto the die advancing conveyor 9 when pulled forwardly by the piston rod 511 after catching the die-set 27.

The die carrying means 505 of the die advancing conveyor 9 comprises a plurality of chains 523 which are provided with a plurality of pushing members 525 for pushing and carrying the die-set 27 forwardly on the rollers 497. The chains 523 are trained around front sprockets 527, rear sprockets 529 and lower sprockets 531 in a manner such that they will be stretched between the front and rear sprockets 527 and 529 horizontally and lower than the tops of the rollers 497 but with their pushing members 525 higher than the rollers 497. The front and rear sprockets 527 and 529 are freely rotatably supported on front and rear brackets 533 and 535, respectively, which are fixedly mounted on front and rear upper portions, respectively, of the frame 489. The lower sprockets 531 are fixed together to a shaft 537 which is freely rotatably supported by and between supporting members 539 fixedly mounted on the lower beams 493 of the frame 489. Also, another sprocket 541 is fixed to the shaft 537 for the lower sprockets 531, and it is connected by means of a chain 543 to another sprocket 545 fixed to the output shaft of a motor 547 which is mounted on frame 489. Thus, when the motor 547 is rotated, the chains 523 are moved around the sprockets 527, 529 and 531 to enable the pushing members 525 to carry forwardly the die-set 27 which has been brought out onto the rollers 497 from the die transferring carriage 5 by the die taking means 503.

The die pushing means 507 of the die advancing conveyor 9 is provided on the front top of the frame 489 and comprises a hydraulic motor 549 having a horizontally forwardly extendable piston rod 551 and a pushing member 553 fixed to the end of the piston rod 551 and having catch members 555 for pushing the die-set 27 forwardly onto the table 17. The pushing member 553 is horizontally slidably mounted between guide plates 557 fixed at the front top of the frame 489. The catch members 555 are the same in function and construction as the catch members 311 of the die pushing means 303 detailedly shown in FIG. 15, and therefore they are depressed and sunk firstly by the die-set 27 pushed forwardly by the pushing members 525 of the chains 523 but they are raised thereafter to push the die-set 27. Also, there is provided at a suitable portion of the frame 489 a limit switch 559 which is so designed as to be actuated when touched by the die-set 27 moving on the rollers 497 and raise the front roller supporting members 163 on the table 17 when actuated. Thus, the die-set 27 is moved on the rollers 497 by the pushing members 525 of the chain 523 beyond the sinkable catch members 555 of the pushing member 553 onto the rollers 135 on the table 17 all of which have been raised, and then it is further pushed forwardly by the catch members 555 of the pushing member 525. Also, as has been roughly described hereinbefore, the hydraulic motor 549 is worked to enable the catch members 555 to push the die-set 27 onto the table 17 when the limit switch 155 is actuated by the front end of the die-set 27.

As has been far described, the die-set 27 can be automatically taken out from the space-saving die stocking rack 7 by the die transferring carriage 5 and brought to the press 1 by means of the die advancing conveyor 9 and the carrier bars 39 and 41 and then automatically loaded onto the press 1 by the lower and upper die holding means 181 and 203. Also, the die-set 27 unloaded from the press 1 is brought rearwards by the carrier bars 39 and 41 and the die returning conveyor 3 and then transferred by the die transferring carriage 5 to any desired one of the die stocking shelves 457A, 457B, 459A and 459B of the die stocking rack 7.

Although a preferred form of the present invention has been illustrated and described, it should be understood that the device is capable of modification by one skilled in the art without departing from the principles of the invention. Accordingly, the scope of the invention is to be limited only by the claims appended hereto.

We claim:

1. A method of changing dies in a press having a work table including a waiting position, a working position and a retiring position, comprising the steps of:

(a) automatically moving a die-set from the working position to the retiring position;

(b) automatically disposing the die-set on a return conveyor and moving it from the retiring position towards a die transferring carriage positioned at the rear of the press;

(c) automatically disposing the die-set on the die transferring carriage and thereon automatically transferring it to a storage rack positioned adjacent thereto;

(d) selecting a new die-set and automatically removing it from the storage rack and disposing it on the die transferring carriage;

(e) automatically transferring the new die-set to a die advancing conveyor and thereon automatically advancing the new die-set to the waiting position; and (f) automatically moving the new die-set from the waiting position to the working position.

2. A method as defined in claim 1, wherein the storage rack includes a plurality of compartmented shelves disposed at different elevations, and said step of transferring the die-set to the storage rack includes determining the particular shelf wherein the die-set is desired to be stored and automatically moving the die transferring carriage both laterally and vertically, as necessary, to bring the die-set into confronting relation with the desired shelf.

3. Apparatus for changing dies in a press, said press including a ram disposed above a work table, said work table having a working position disposed beneath the ram, a waiting position to the left of the ram and a retiring position to the right of the ram, means for moving dies along said table from said working position to said retiring position, means for moving dies along said table from said waiting position to said working position, means disposed behind said ram for stocking a plurality of dies for use in the press, and means for automatically moving dies from said retiring position to said stocking means and from said stocking means to said waiting position when changing the dies in the press.

4. Apparatus as defined in claim 3, wherein said means for automatically moving dies includes a die returning conveyor associated with said retiring position and a die advancing conveyor associated with said waiting position.

5. Apparatus as defined in claim 4, wherein said stocking means is a storage rack having a plurality of die stocking shelves, and further including die transferring carriage means movably mounted in front of said storage rack for transferring dies from said die returning conveyor to said rack and for transferring dies from said rack to said die advancing conveyor.

6. Apparatus as defined in claim 5, wherein said shelves are provided at different elevations in said rack, and wherein said die transferring carriage means includes die moving means vertically movably mounted thereon for moving dies into and out of said shelves at the different elevations thereof.

7. Apparatus as defined in claim 5, wherein said die returning conveyor means and said die advancing conveyor means extend rearwardly from said work table on opposite sides of the press, and said die transferring carriage means and said storage rack are disposed behind the press and extend parallel to said work table so that the press is surrounded on all four sides by said work table, said die returning conveyor means, said carriage means and said storage rack, and said die advancing conveyor means.

8. Apparatus as defined in claim 3, wherein the dies are die-sets including an upper die and a lower die, means provided in said work table for holding said lower die at said working position, and means provided in said press ram for holding said upper die.

* * * * *